US007395980B2

(12) United States Patent
Haack et al.

(10) Patent No.: US 7,395,980 B2
(45) Date of Patent: Jul. 8, 2008

(54) DEVICE FOR SEPARATING AND TRANSPORTING AWAY RAW MATERIALS

(75) Inventors: Oliver Haack, Martha-Brautzsch-Strasse 8, D-06108 Halle (DE); Egon Ehrle, Schoeneiche (DE)

(73) Assignee: Oliver Haack, Halle (DE)

( * ) Notice: Subject to any disclaimer, the term of this patent is extended or adjusted under 35 U.S.C. 154(b) by 371 days.

(21) Appl. No.: 10/550,443

(22) PCT Filed: Mar. 19, 2004

(86) PCT No.: PCT/DE2004/000572

§ 371 (c)(1),
(2), (4) Date: Sep. 21, 2005

(87) PCT Pub. No.: WO2004/082834

PCT Pub. Date: Sep. 30, 2004

(65) Prior Publication Data

US 2007/0000397 A1 Jan. 4, 2007

(30) Foreign Application Priority Data

Mar. 21, 2003 (DE) ..... 103 12 605

(51) Int. Cl.
*B02C 18/30* (2006.01)

(52) U.S. Cl. ..... 241/82.5; 241/82.7

(58) Field of Classification Search ..... 241/82.1–82.7
See application file for complete search history.

(56) References Cited

U.S. PATENT DOCUMENTS 4,422,582 A 12/1983 Roeger et al.
4,795,104 A 1/1989 Rudibaugh ..... 241/82.5

(Continued)

FOREIGN PATENT DOCUMENTS

DE 221379 4/1985

(Continued)

OTHER PUBLICATIONS

English translation of International Preliminary Report on Patentability.

*Primary Examiner*—Mark Rosenbaum
(74) *Attorney, Agent, or Firm*—Collard & Roe, P.C.

(57) ABSTRACT

The invention relates to a device for separating and transporting away raw materials once they have been ground, from cutting tools embodied as separating/cutting units and pertaining to machines for meat mincing, especially mincers. The inventive device is embodied as an adaptable tool and can be associated with separating and cutting units (1) of mincers. Said device is characterized by a transporting tube (4) and a discharge screw (3) arranged inside said tube and driven by external means. Furthermore, the adaptable tool and the discharge screw can be positioned and arranged in different positions for each separating and cutting unit (1). The discharge screw (3) is thus associated with each respective separating and cutting unit (1) in a central or axial arrangement or in an arrangement which is displaced by 90° in relation to the axial direction of the separating and cutting unit (1) and in relation to the transport direction of the raw material or in an arrangement which is also displaced by 90° in relation to the center of the axis of the separating and cutting unit (1) between the inner wall of the cutting unit housing (2) and the separating and cutting unit (1), forming a defined angle associated with the separating and cutting unit (1).

8 Claims, 8 Drawing Sheets

U.S. PATENT DOCUMENTS 5,405,095 A * 4/1995 Lesar ..... 241/82.5
5,944,267 A * 8/1999 Haack et al. ..... 241/82.1
5,979,804 A 11/1999 Garren, Jr.

FOREIGN PATENT DOCUMENTS

DE 38 20 316 C2 12/1989
DE 43 01 785 C2 7/1994
DE 197 34 611 C1 1/1999
DE 199 04 619 C1 7/2000
WO WO 92/01455 9/1992

* cited by examiner

DEVICE FOR SEPARATING AND TRANSPORTING AWAY RAW MATERIALS

The invention relates an apparatus for the separation and removal of raw materials following their diminution consisting of cutting tools structured as separation cutting sets of meat diminution machines and meat grinders in particular.

Conventional separation devices of the kind under consideration are generally structured to remove the bone chips, cartilage, sinews and other collagenous tissue from the immediate production flow of meat which may take place in an axial as well as in a radial direction. Thus, German patent specification DE 38 20 316 A1 relates to a separation device for a meat grinder consisting of a feed screw for moving the meat and a cutting set of at least one rotationally driven wing knife and at least one stationary perforated disc and the separation device for the removal of undesirable components through a central bore in the perforated disc. For adjusting the output slot in the central bore of the perforated disc, the separation device is provided with an axially moveable inner sleeve and a component which may be adjusted by a screw.

German patent specification DE 43 01 785 A1 relates to the problem of adjusting the output slot of such separation devices in which any undesirable components are removed through a central bore in the perforated disc. The arrangement relates primarily to the adjustment of the output slot, i.e. the annular output opening of the components to be separated, from the exterior during operation. In the proposed separation device this is accomplished by a separation tube being provided over the length of the entire separation system and which is provided with an adjustment device and which is mounted relative to the terminal perforated disk by a counter nut and an adjustment bush.

Moreover, German patent specification DE 197 34 611 C1 discloses a separation cutting set for meat diminution machines which may be structured as a single part or as several parts. Structured of multiple parts, it consists of a pre-cutter, a normal knife, a perforated disc, a separation knife and a terminal perforated disc structured as a perforated separator disc. More particularly, the perforated separator disc is provided with a blind bore into which a transverse bore enters as an output channel and in the inner wall of which feed enhancing aids structured as flues are provided. The separation channel is unilaterally provided in the perforated separator disc and enters into the blind bore with half the cross-section of its surface. The perforated separator disc is incorporated and arranged in the remaining part of the cutting set within the cutting set housing such that on the one hand the separator knife with its oblique groove blades provided in front of the perforated separator disc directly engages the surface of the perforated separator disc whereas the perforated separator disc, as is well-known, is itself clamped against the housing of the cutting set by a sleeve nut.

In this arrangement, the removal of the undesirable components from the processed material takes place by way of the radially outwardly directed output channel. The arrangement also proposes to provide two perforated separator discs structured as described within a housing of a cutting set, with the second perforated separator disc repeating the diminution of the material by way of the perforations of the forwardly arranged perforated separator disc. The undesired components are removed through the radially outwardly extending output channel.

Reference is also to be had to German patent specification DE 199 04 619 C1 which also discloses a multiple separation and cutting set for meat processing machines, especially meat grinders, which in connection with these multiple separation and cutting sets ensures the realization of a firmness separation method operating on the basis of deviations in the mechanical firmness of the material between different raw materials. These differences in firmness may be best achieved by material tempering during the diminution process. In addition to the multiple separation and cutting task, a further tool structure ensures warming of the through-flowing materials to be ground.

Furthermore, a multiple separation and cutting set has been created as a multi-component cutting set which can be used in meat diminution machines, meat grinders in particular, which makes possible qualitative cutting of the material to be processed as well as qualitative removal of undesirable components from the material to be processed, even of materials frozen to at least −20° C.

While this multiple separation and cutting set allows processing of frozen materials, it suffers from the disadvantage that qualitative grinding and removal is possible only in the presence of super pressure in the working chamber of the multiple separation and cutting set. Controlled removal of the components of the ground raw material cannot be realized at all or at considerable complexity only.

It is thus an object of the invention to provide an apparatus for separating and removing raw materials following their diminution consisting of cutting tools structured from separation cutting set which independently of any back pressure makes possible qualitative diminution and separation of the raw materials to be ground and removed, and which substantially eliminates the drawbacks of the state of the art.

In accordance with the invention the object is accomplished by the characteristics of claim 1. Advantageous solutions and special embodiments may be gleaned from the subclaims.

An arrangement, more particularly meat grinders, for separating and removing ground raw materials has thus been created which may be associated with the housing of the cutting set of a meat grinder. The essential characteristics of the novel arrangement are an externally driven discharge screw journaled in a feed tube and its arrangement and association with the corresponding separation and cutting set of a meat grinder. In this connection, it is important that the discharge screw may be positioned and arranged in different positions relative to the separation and cutting set. Thus the discharge screw is associated with the corresponding separation and cutting set in a central axial disposition or in a disposition displaced 90° relative to the axial direction of the separation and cutting set and the direction of feed of the raw material, or in a disposition displaced 90° relative to the axis of the separation and cutting set between the inner wall of the cutting set housing and the separation and cutting set and always at a predetermined angle relative to the separation and cutting set.

It is an element of the invention that the discharge screw is driven by an external drive, e.g. a pneumatic motor, so that the discharge screw is controlled and regulated independently of the drive system of the meat grinder. The connection from the drive motor to the discharge screw consists of a support and drive element which extends through the feed tube in which the discharge screw is revolving and which connects with the discharge screw. The incorporation and arrangement of the discharge screw with respect to the separation and cutting set depends upon its desired position which determines the structure of any given connection.

Disconnecting the discharge screw from the drive of the separation and cutting set is important in the context of the novel arrangement. The discharge screw thus is no longer affected by the operating pressure in the separation and cutting set and may be controlled and regulated by way of its own drive element such that raw material may be removed as required.

For this purpose the drive motor of the discharge screw is connected to a computer for controlling the drive motor and, therefore, the discharge screw. This means that the output quantity of raw material or of the proportion of raw material no longer depends upon the operating pressure within the separation and cutting set. In this manner, the discharge screw may be controlled in respect of quantity as well as by sensors, and it also takes on the blocking function in respect of the feeding of raw material components. Hence, when the discharge screw is idle no raw material will be conveyed and the output openings are substantially closed, whereas during operation specific and controlled feeding is possible as a function of the rotational speed.

Another element of the invention is that with a central disposition of the discharge screw, the bearing and mounting thereof with respect to the separation and cutting set is achieved by a bearing bush which is connected to the terminal perforated disc of the separation and cutting set and in which the feed tube is also received.

In an arrangement in which the discharge screw is displaced by 90°, it is journaled within the separation and cutting set such that the discharge screw is journaled in the area of the blind bore of the terminal perforated disc, the latter being structured as a longitudinally separated perforated disc provided with semicircular openings which upon mating of the two halves of the perforated disc for the bearing housing or journal for the discharge screw.

Where the discharge screw is disposed between the internal wall of the separation and cutting set housing and the cutting set components, the internal wall of the separator and cutting set housing as well as the perforated separator disc provided in this area have concavely shaped recesses which constitute the support for the discharge screw.

Where the discharge screw is disposed angularly it is journaled directly in the separator and cutting set housing of the meat grinder.

It is within the ambit of the invention to provide the entire device as a structural unit consisting of a so-called support body in which the feed tube and the discharge screw are journaled and that the entire support body is connected to the separation and cutting set housing by a clamping flange and clamping nut.

The advantages of the described apparatus are, in particular, that the external drive of the discharge screw makes possible to control and regulate the discharge screw independently of the operating pressure of the meat grinder which, in turn, leads to an output of the raw material or raw material components independent from the operating pressure of the meat grinder, that the discharge screw may be controlled in terms of quantity as well as by sensors and that because of its control and regulation, the discharge screw provides a blocking function substantially in the manner of a valve depending upon the operation or idleness of the discharge screw.

The invention will hereafter be described in greater detail on the basis of an embodiment. In the related drawing.

Figure 9:
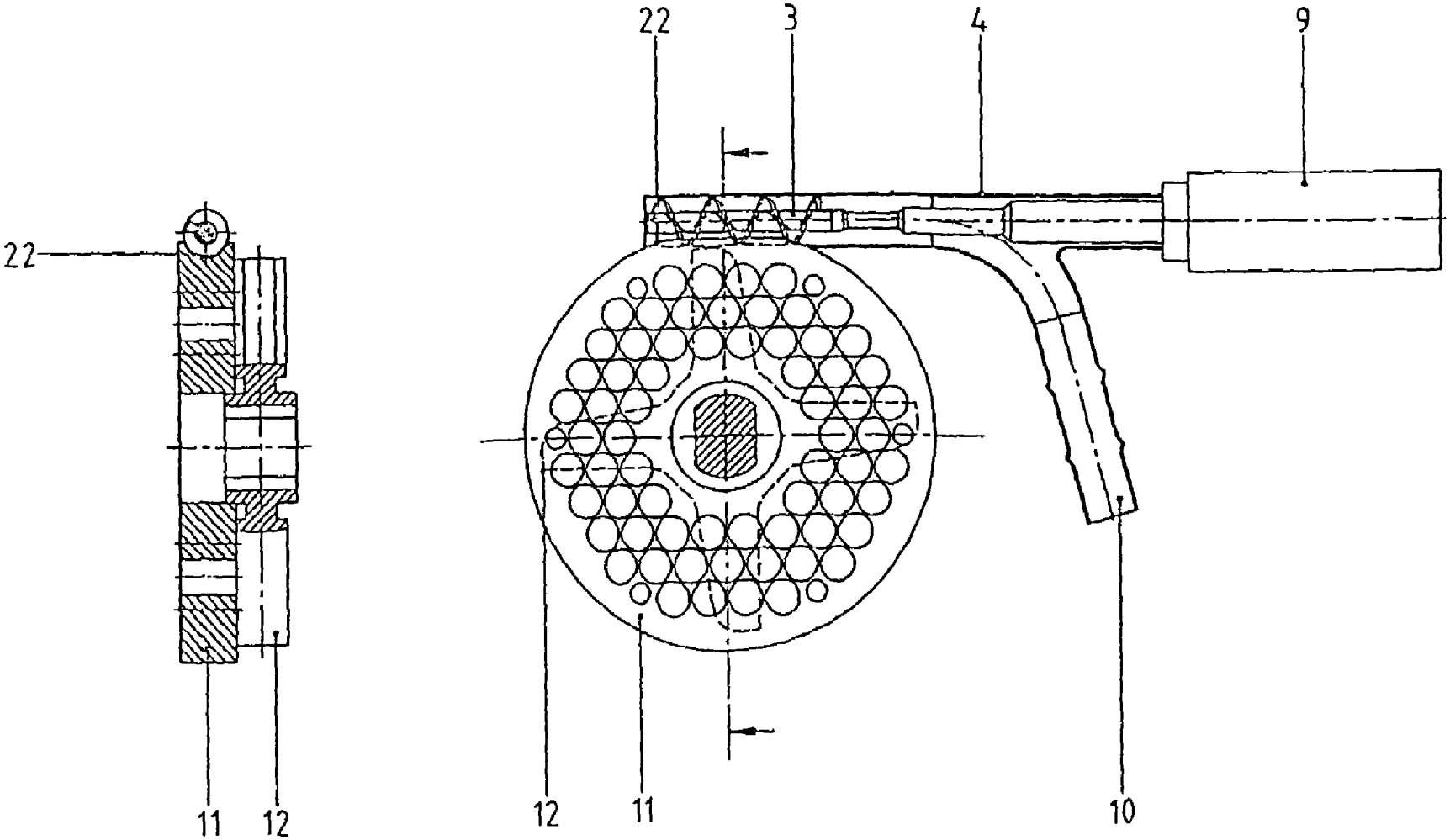
Figure 10:
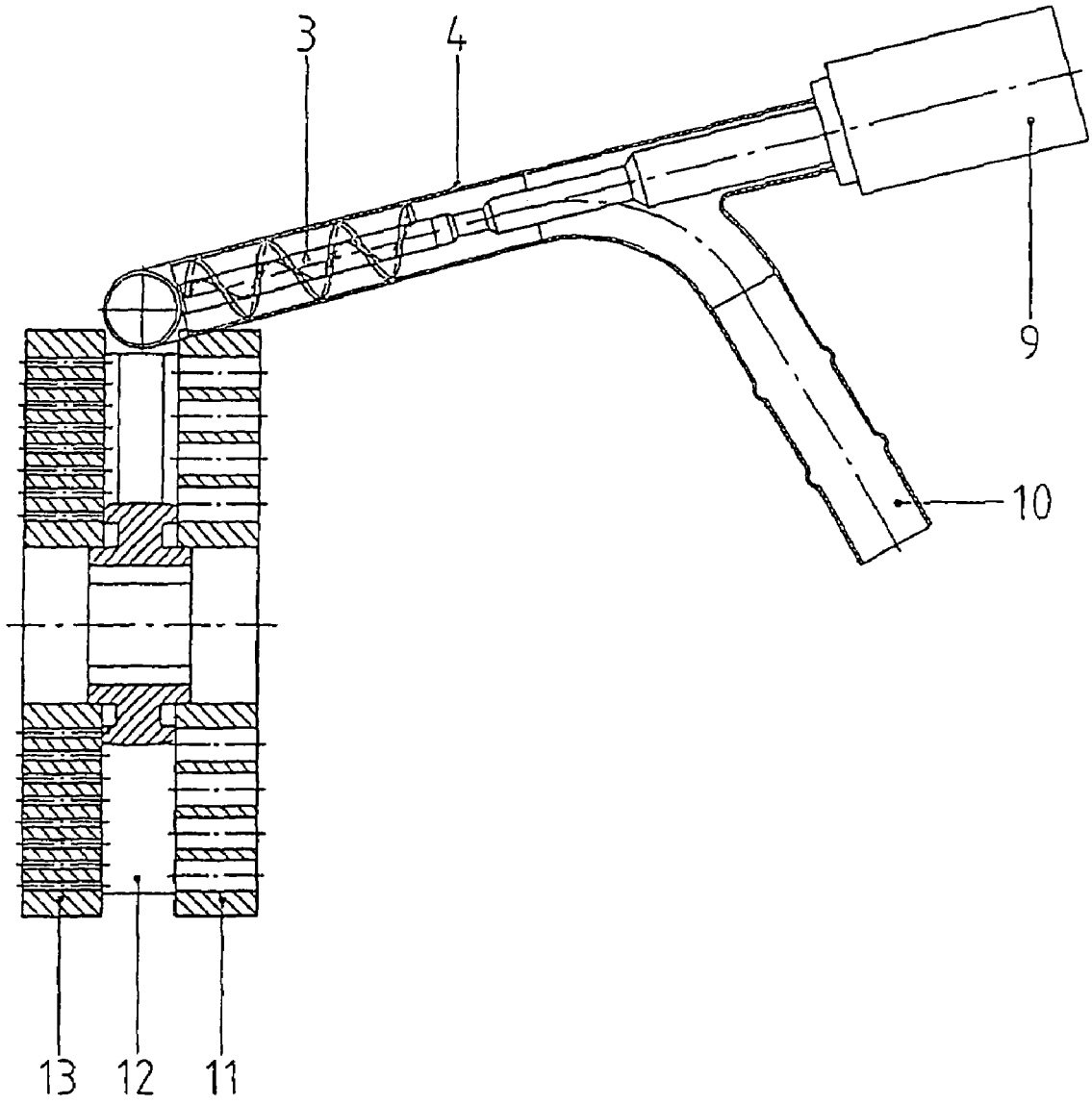

FIG. 9 schematically depicts a further embodiment of the arrangement of the discharge screw the relative to the separator and cutting set;

FIG. 10 is a further embodiment of the arrangement of the discharge screw relative to a separator and cutting set.

Figure 1:
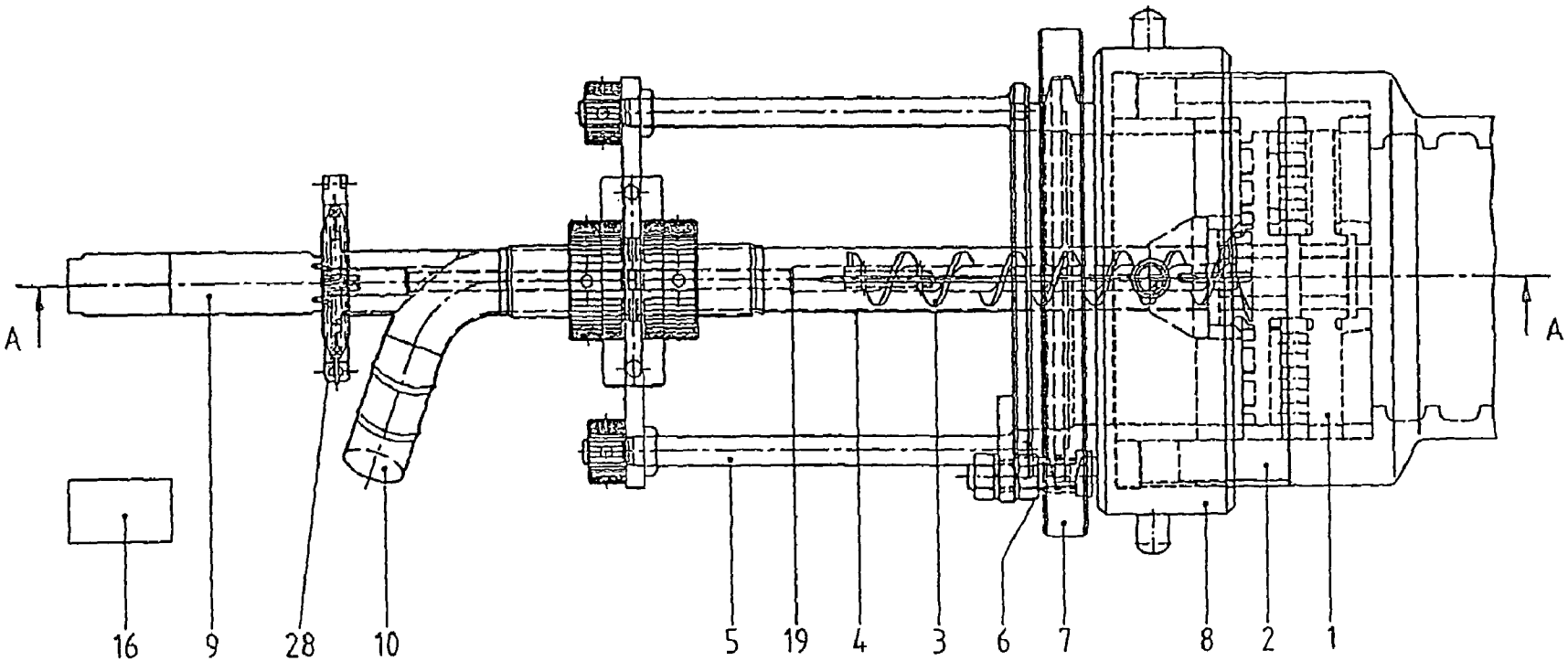
FIG. 1 depicts the arrangement of a discharge screw journaled centrally of a separator and cutting set.

FIG. 1 is an overall view of the structure of the device for separating and feeding, structured as an accessory, as well as its association with a separator and cutting set housing 2 and the separator and cutting set 1 disposed therein. The support body 5 of the device in which the feed tube 4 and the discharge screw 3 arranged therein are journaled, is connected to a clamping nut 8 by its support ring 6 and the clamping flange 7. The clamping nut 8 is provided with an internal thread and may be threaded onto an exterior thread of the separator and cutting set housing 2. At its output end the feed tube 4 is provided with curved tube 10.

The discharge screw 3 is journaled with respect to the separator and cutting set 1 by a pin 23 provided on the shaft 17 of the knife. The feed tube 4 is connected to the perforated separator disc 11 by a threaded bush 25. At the left end the discharge screw 3 and the feed tube 4 are journaled in a receptor 28, the discharge screw 3 being connected to a drive motor 9 by way of a support and drive element 19. Preferably, the drive motor 9 is a pneumatic motor. The support and drive element 19 penetrates through the curved tube 10 of the feed tube 4, and the drive motor 9 is connected to a computer 16.

Figure 2:
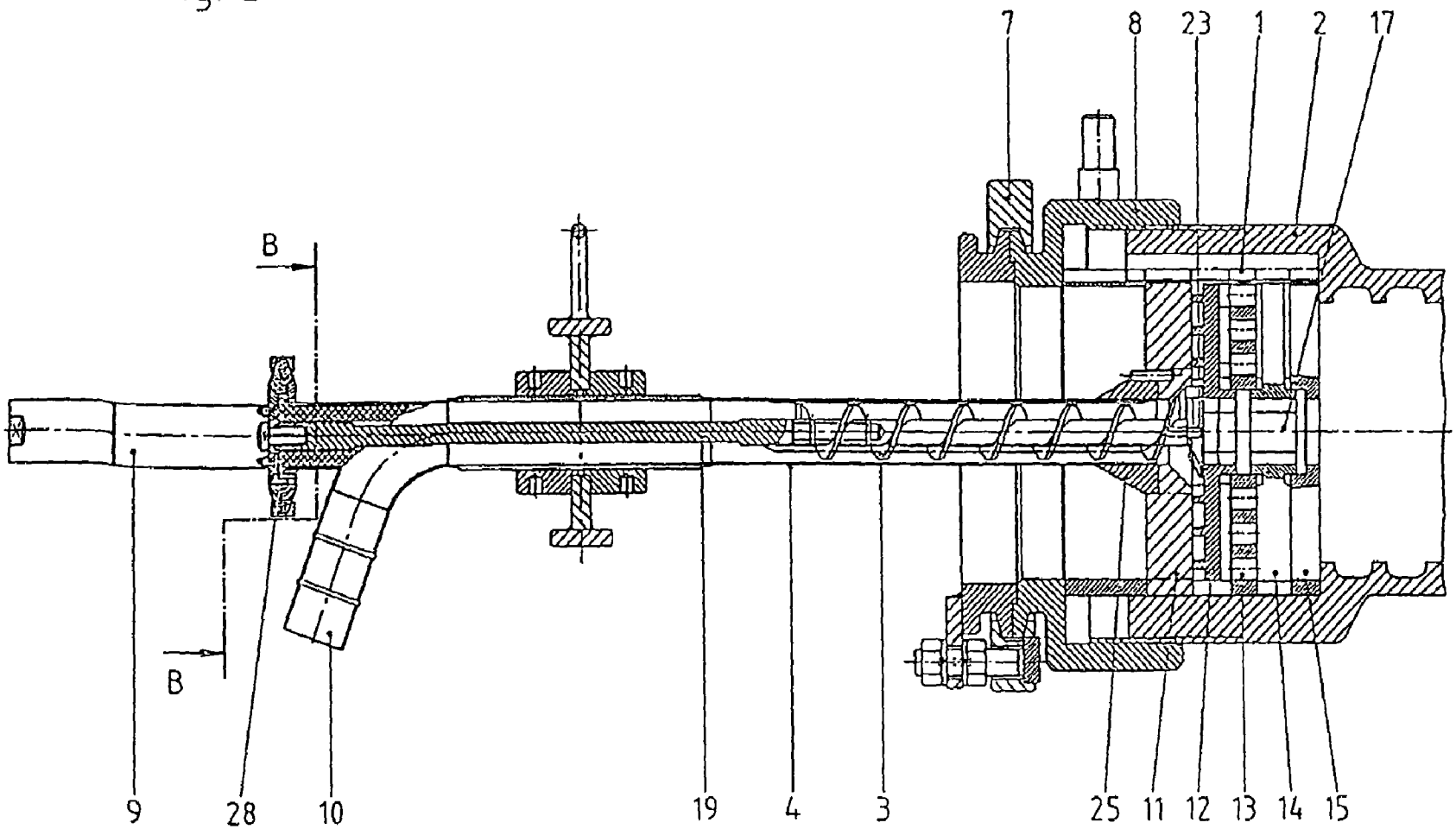
FIG. 2 depicts a sectional view along line A-A of FIG. 1.

FIG. 2 depicts the individual functional components of the separation and cutting set 1 as well as their arrangement within the separation and cutting set housing 2. Thus, the separation and cutting set 1 consists of a pre-cutter 15 followed by a knife 14, a first perforated disc 13, the succedent separator knife 12 and the perforated separator disc 11. The precutter 15 and the perforated discs 13, 11 are stationarily arranged within the separating and cutting set housing 2, whereas the first knife 14 and the separator knife 12 are seated on, and revolve with, the knife pin of a feed screw not shown in any detail. At its forward end the knife shaft is provided with a pin 23 for receiving the discharge screw 3.

Figure 3:
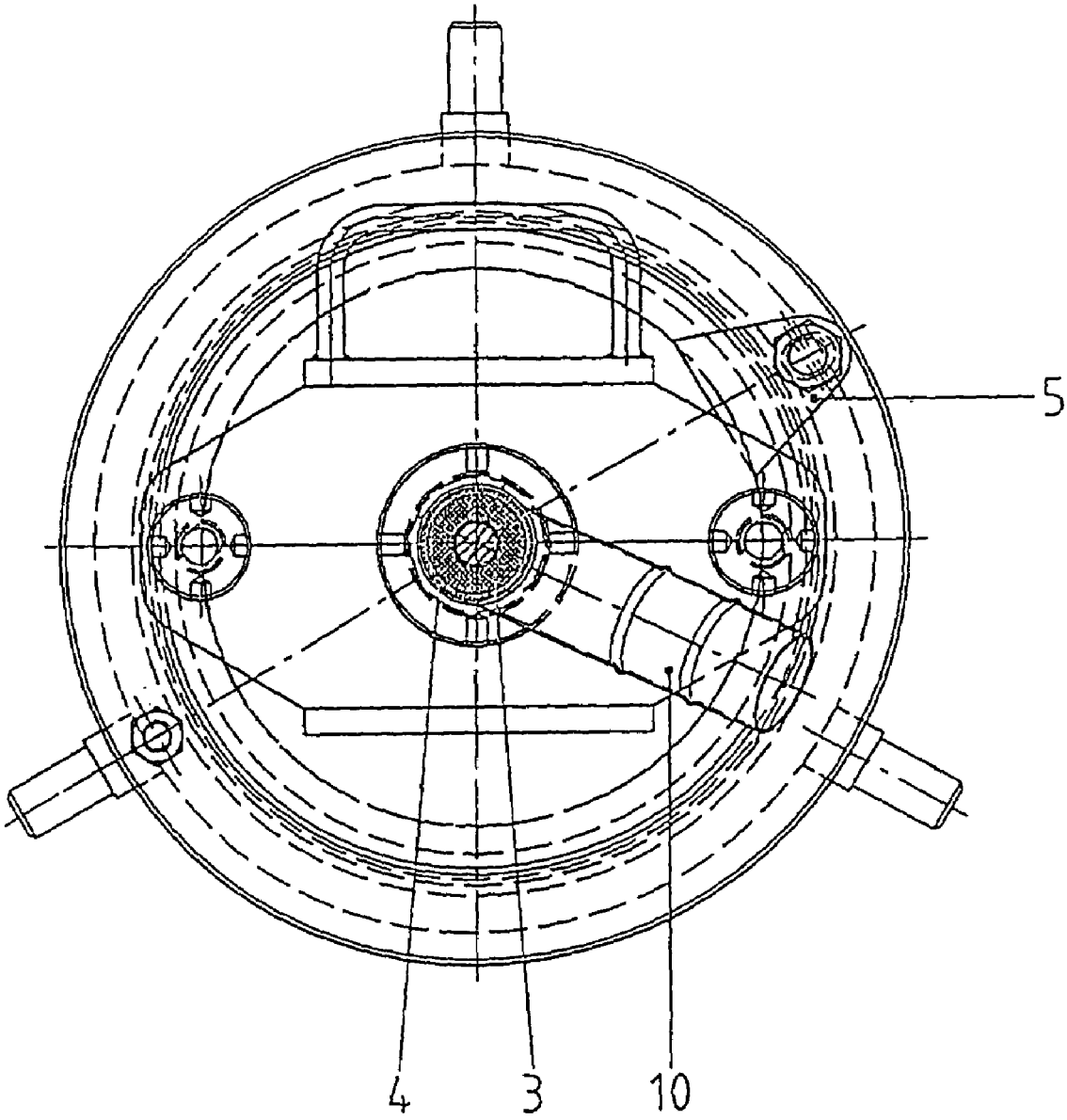
FIG. 3 depicts a sectional view along line B-B of FIG. 2.

FIG. 3 which is a sectional view based on FIG. 2 shows the central disposition and bearing of the discharge screw 3 with respect to the separation and cutting set 1 positioned behind it. It shows how the entire support body 5 may be handled by support elements during assembly or disassembly. The very simple connection of the support body 5 to the separation and cutting set housing 2 ensure quick change-over times, which is particularly advantageous during cleaning or replacement of individual parts of the separation and cutting set 1.

Figure 4:
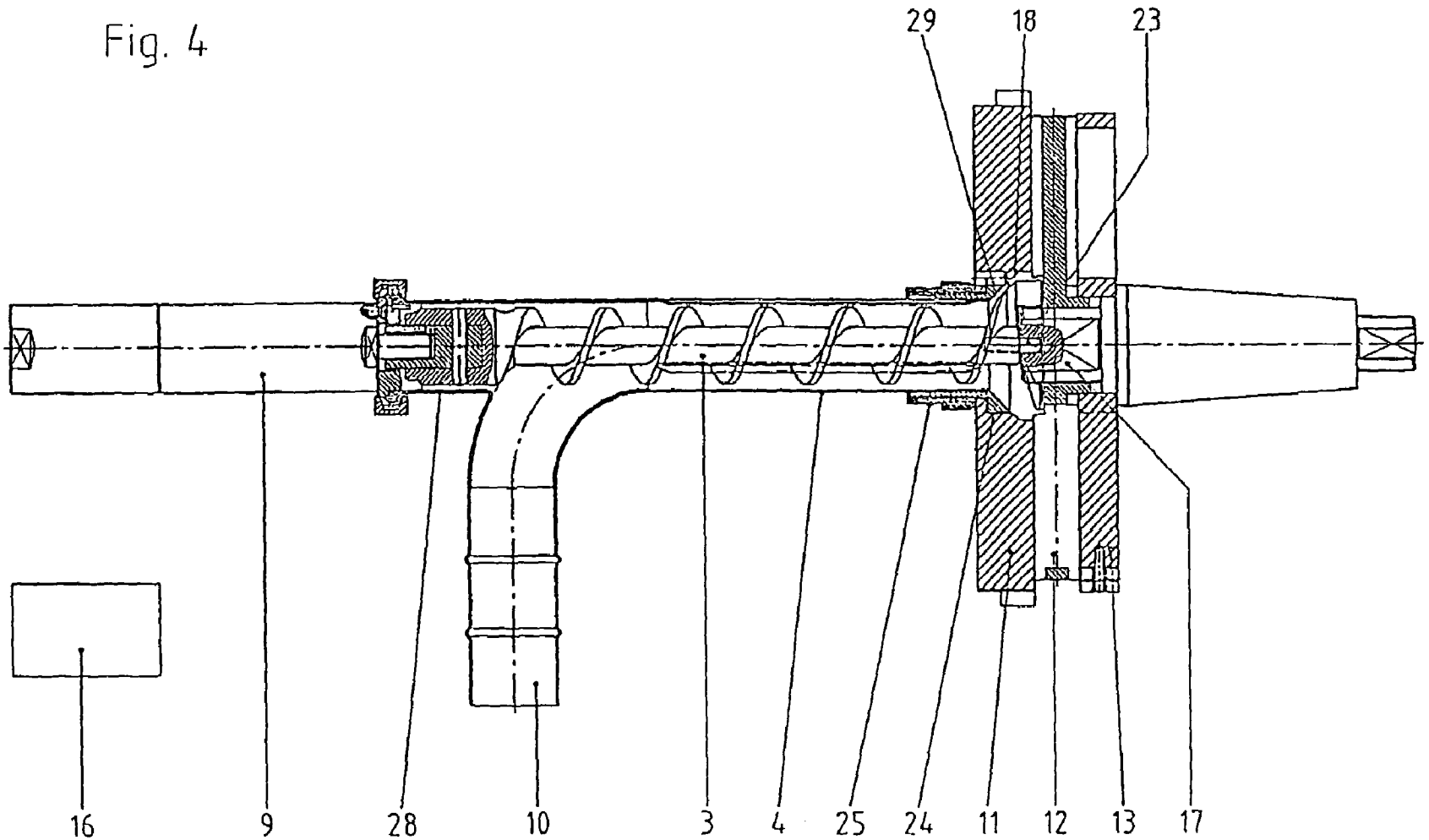
FIG. 4 is a view in detail of the central arrangement of the discharge screw of FIG. 1.

The detailed view of FIG. 4 depicts the association of the discharge screw 3 and the separation and cutting set 1 as well as the support of the discharge tube 4. The discharge tube 4 is seated in a bush 24 which is received in a blind bore in the perforated separator disc 11. The discharge tube 4 is clamped against the bearing bush 24 by a threaded bush 25. The direct support and positioning of the discharge screw 3 on the knife shaft pin 17 may also be seen in this detailed view. This is accomplished by the pin 23 in the knife shaft by the central blind bore of the discharge screw 3 being pushed onto the pin 23 to form a positive connection therewith. In this area, i.e. at its one end, the discharge screw 3 is structured and positioned in the perforated separator disc 11 such that passage 18 is formed between the input beveling 29 of the bearing bush 24 inserted in the perforated separator disc 11 and the discharge screw 3 by which raw materials of components thereof to be removed are moved from the knife chamber of the separation and cutting set housing 2 into the range of the discharge screw 3 from where they will then be removed through the curved tube 10 of the feed tube 4.

At its opposite end the discharge screw 3 is journaled in the feed tube 4 such that the discharge screw 3 connects to the drive motor 9 by means of a suitable connecting element to be put into rotational movements. The drive motor 9 is energized by a computer 16 in which are stored the technical data relating to the machine as well as specific data relating to the raw material to be processed. The data are compared to provide parametric results for energizing and controlling the drive motor 9 with reference to given operating conditions. The central and axial disposition of the discharge screw 3 relative to the separator and cutting set 1 can be clearly seen in FIGS. 1 to 4.

Figure 6:
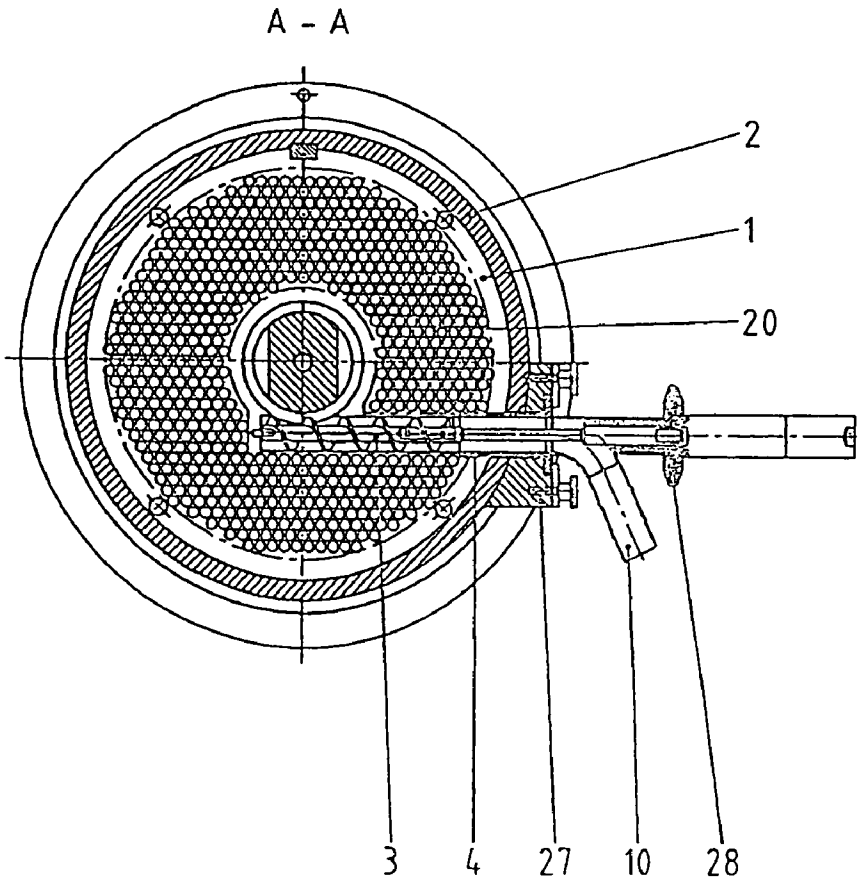
FIG. 6 is a sectional view along line A-A of FIG. 5.
Figure 5:
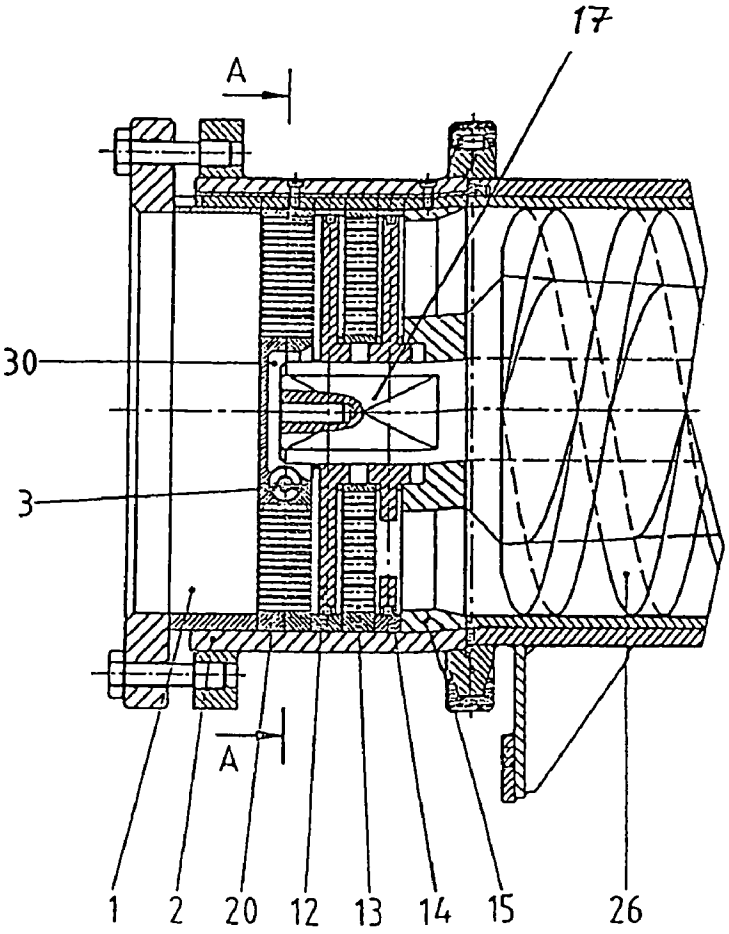
FIG. 5 is a sectional view of a separation and cutting set with a discharge screw displaced 90° relative thereto.

The arrangement and incorporation of the discharge screw 3 transversely relative to the separator and cutting set 1, i.e. displaced 90° relative to the direction of feed, is shown in FIGS. 5 and 6.

FIG. 5 shows a section of the feed screw 26 of a meat grinder which in the direction of the separation and cutting set 2 extends into the knife shaft 17 on which the knife 14 and the separator knife 17 are rotatably mounted. In this area the discharge screw 3 is journaled directly in the terminal perforated separator disc 20 such that on the one hand the bearing of the discharge screw 3 is secure and that, on the other hand, the raw material components can be positively conveyed by the separation knife 12 into the area of the discharge screw 3 which then removes them. The accessory is mounted on the housing of the separation and cutting set 2 by a support body 27.

The terminal perforated separation disc 20 is a longitudinally divided perforated disc provided with recesses which in the assembled state of the disc 20 perforated separation disc 20 provide a bearing housing 21 for the discharge screw 3. One half of the perforated separation disc 20 is provided with a penetrating center bore and the other half of the perforated separation disc 20 is provided with a central blind bore 30 so that no central outflow of raw material or raw material components is possible; instead any outflow occurs through the discharge screw 3.

Figure 7:
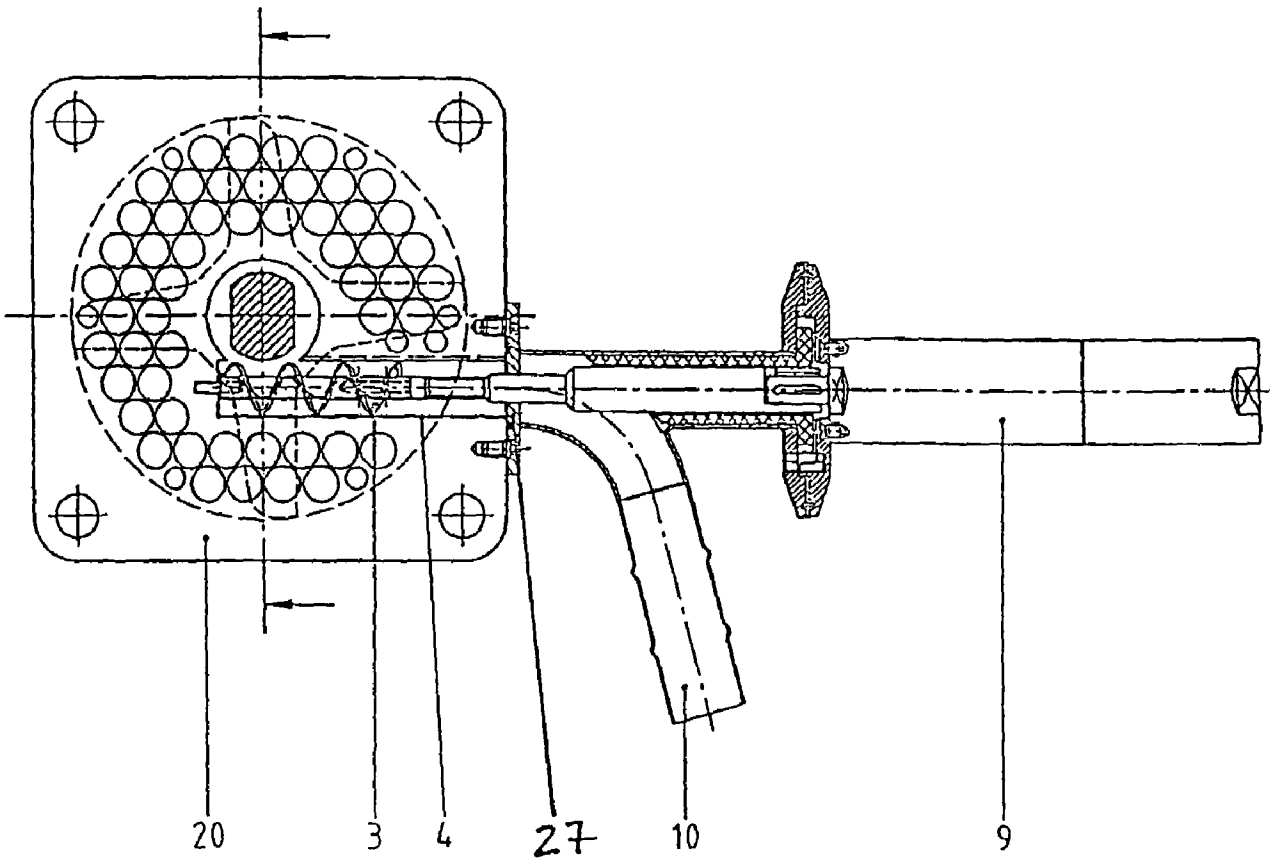
FIG. 7 is a view in detail of the arrangement of the discharge screw of FIG. 1.
Figure 8:
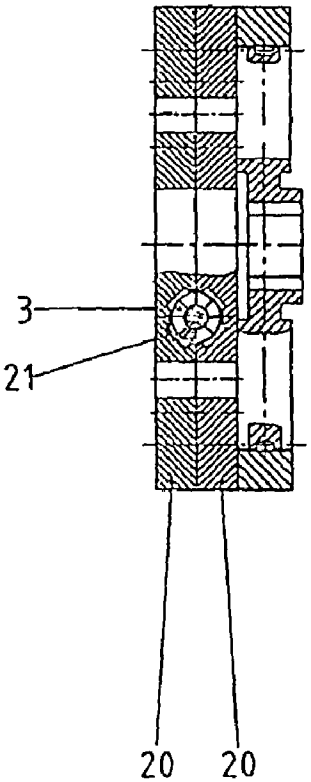
FIG. 8 depicts a divided perforated separator disc.

FIG. 8 depicts a longitudinally divided perforated terminal separation disc 20 in its assembled state and clearly shows the formation from the two recesses, by the placing together of the two halves of the perforated terminal separation disc 20, of the bearing housing 21 for the discharge screw 3. As shown by FIG. 7, the bearing housing 21 is formed at a distance from the axis of the separation and cutting set 1.

A further embodiment of arranging the discharge screw 3 relative to the separation and cutting set 1 may be seen in the schematic presentation of FIG. 9. In this embodiment, too, the discharge screw 3 is displaced 90° relative to the direction of feed of the meat grinder, i.e. transversely of the axis of the separation and cutting set 1, and it is disposed in the upper area thereof between the separation and cutting set 1 and the internal wall of the separating and cutting set housing 2. In this embodiment the discharge screw 3 is supported by a support surface 22 concavely formed and provided in an upper portion of the perforated separation disc. The perforate separation disc 11 constitutes only a part of the support of the discharge screw 3. The component complementing the concave configuration in the perforated disc 11 is provided in the separation and cutting set housing 2 so that during assembly of the separation and catting set 1 in this area a circular opening results which serves as a support surface 22 for the discharge screw 3.

A forth embodiment of the association of the discharge screw 3 relative to the separation and cutting set 1 is shown in the schematic view of FIG. 10 in which the discharge screw 3 and its discharge tube 4 are disposed at a predetermined angle relative to the separation and cutting set 1 and its separation and cutting set housing 2. The initial section of the discharge screw 3 is positioned between the perforated disc 13 and the perforated separation disc 11 so in this area it enters into the knife chamber of the separating knife 12 so that raw material components may be removed from the knife chamber.

The proposed arrangement makes it possible, in accordance with particular requirements, the kind of raw material or on the basis of parameters measured by sensors, to control and vary the degree of separation and the output quantity of the raw material components to be removed. This is possible independently of the pressure within the housing 2 of the cutting set. This is a substantial advantage over similar prior art separation devices. It is realized by the controllability of the drive motor 9 of the discharge screw 3. The number of rotations of the discharge screw 3 is controlled in the range between $n=0\ min^{-1}$ to $n=max.\ min^{-1}$. Thus, the discharge screw 3 is rotated at intervals. That is to say that at a number of rotations $n=0\ min^{-1}$, the discharge screw 3 satisfies its blocking function as no raw material components are removed by the discharge screw 3. All other rotational speeds of the discharge screw 3 up to $n \geqq max.\ min^{-1}$ correspond to a predetermined removal quantity which is removed at a given effective location by applying extraneous energy. The individual numbers of rotation $n \geqq 0\ min^{-1}$ thus represent defined "opening positions" of the discharge screw 3 the desired number of rotations of which are achieved by energizing its drive motor 9.

Thus, quantities of raw materials or raw material components are removed which far exceed the back pressure dependent feed quantities of prior art devices. The operation may be further improved by applying vacuum or super pressure. Qualitative and quantitative removal of raw material or raw material components is ensured as a function of different numbers of rotation. As has already been mentioned, this is accomplished by energizing the drive motor 9 which is connected to the computer 16 which is affected by data representative of prevailing operating conditions during the diminution and separation process as well as by data relating to desired parameters relating to the ground raw material and its components.

By controlling the discharge screw 3 the quantity of the raw material or raw material components to be removed can be regulated; the discharge screw 3 is thus assuming a control function.

The invention claimed is:

1. A meat grinder, comprising:

a housing;

cutting tools mounted in the housing, said cutting tools being structured as a multiple component separation and cutting set consisting of a precutter, a separation disc, a perforated separation disc, and knives; and an accessory comprising:

(A) a discharge screw rotating in a discharge tube;

(B) a receiving body;

(C) a support and drive element for driving the discharge screw; and (D) a drive motor mounted to the housing, wherein the discharge screw is arranged transverse to the separation and cutting set, displaced 90 degrees relative to a feed direction and is journaled at a first end in a longitudinally divided terminal perforated separation disc and at a second end by way of the discharge tube and a receiving body, wherein the discharge tube is received in a support body that is arranged laterally of the housing.

2. The meat grinder of claim 1, wherein the discharge tube is provided with a curved tube at an output end, and wherein the discharge tube is arranged in a support body that is connected to the housing by a support ring, a clamping flange and a clamping nut.

3. The meat grinder of claim 1, wherein the drive motor is a pneumatic motor and is connected to a computer.

4. The meat grinder according to claim 1, wherein prevailing operating conditions are recorded by sensors arranged in and at the housing, said conditions being fed to a computer where they are correlated and wherein the drive motor is energized by the computer so that the discharge screw is controlled independently of any operating pressure of the separation and cutting set.

5. A meat grinder, comprising:

a housing;

cutting tools mounted in the housing, said cutting tools being structured as a multiple component separation and cutting set consisting of a precutter, a separation disc, a perforated separation disc, and knives; and an accessory comprising:

(A) a discharge screw rotating in a discharge tube;

(B) a receiving body;

(C) a support and drive element for driving the discharge screw; and (D) a drive motor mounted to the housing, wherein the discharge screw is arranged transverse to the separation and cutting set, displaced 90 degrees relative to a feed direction;

wherein the discharge screw is journaled in a longitudinally divided terminal perforated separation disc.

6. The meat grinder of claim 5, wherein the discharge tube is of limited length and rotates in an exposed state in a range of openings of halves of the terminal perforated separation disc to receive raw materials over an entire effective width of the terminal perforated separation disc.

7. A meat grinder, comprising:

a housing;

cutting tools mounted in the housing, said cutting tools being structured as a multiple component separation and cutting set consisting of a precutter, a separation disc, a perforated separation disc, and knives; and an accessory comprising:

(A) a discharge screw rotating in a discharge tube;

(B) a receiving body;

(C) a support and drive element for driving the discharge screw; and (D) a drive motor mounted to the housing, wherein the discharge screw is arranged transverse to the separation and cutting set, displaced 90 degrees relative to the feed direction and between the separation and cutting set and an internal wall of the housing; wherein the perforated separation disc and the internal wall of housing are provided with concavely structured recesses which in an assembled state of the separation and cutting set constitute the support of the discharge screw.

8. A meat grinder, comprising:

a housing;

cutting tools mounted in the housing, said cutting tools being structured as a multiple component separation and cutting set consisting of a precutter, a separation disc, a perforated separation disc, and knives; and an accessory comprising:

(A) a discharge screw rotating in a discharge tube;

(B) a receiving body;

(C) a support and drive element for driving the discharge screw; and (D) a drive motor mounted to the housing, wherein the discharge screw is arranged transverse to the separation and cutting set, displaced 90 degrees relative to a feed direction; wherein the discharge crew is disposed between an internal wall of the housing and an outer circumference of the knife, and between the perforated separation disc and the perforated disc, and wherein the discharge screw is journaled in the wall of the housing.

* * * * *